US008217839B1

(12) United States Patent
Paulsen

(10) Patent No.: US 8,217,839 B1
(45) Date of Patent: Jul. 10, 2012

(54) STRIPLINE ANTENNA FEED NETWORK

(75) Inventor: Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 705 days.

(21) Appl. No.: 12/286,062

(22) Filed: Sep. 26, 2008

(51) Int. Cl.
*H01Q 1/38* (2006.01)
*H01Q 21/10* (2006.01)
*H01Q 21/26* (2006.01)

(52) U.S. Cl. ..... 343/700 MS; 343/810; 343/797; 343/798

(58) Field of Classification Search ..... None
See application file for complete search history.

(56) References Cited

U.S. PATENT DOCUMENTS

| | | | | |
|---|---|---|---|---|
| 3,747,114 | A * | 7/1973 | Shyhalla | 343/795 |
| 5,216,430 | A * | 6/1993 | Rahm et al. | 343/700 MS |
| 6,239,762 | B1 * | 5/2001 | Lier | 343/770 |
| 6,756,939 | B2 * | 6/2004 | Chen et al. | 342/372 |
| 7,026,889 | B2 * | 4/2006 | Sledkov | 333/128 |
| 8,138,989 | B2 * | 3/2012 | Mohamadi | 343/905 |
| 2002/0005806 | A1 * | 1/2002 | Perrott et al. | 343/700 MS |
| 2004/0021613 | A1 * | 2/2004 | Nesic et al. | 343/795 |
| 2004/0239444 | A1 * | 12/2004 | Sledkov | 333/128 |
| 2009/0146904 | A1 * | 6/2009 | Shi et al. | 343/893 |

* cited by examiner

*Primary Examiner* — Trinh Dinh
(74) *Attorney, Agent, or Firm* — Donna P. Suchy; Daniel M. Barbieri

(57) ABSTRACT

A stripline antenna feed network is described. The stripline antenna feed network may comprise a first stripline layer comprising one or more reactive splitters and one or more matched splitters; and a second stripline layer comprising one or more reactive splitters. A method of manufacturing a stripline antenna feed network may comprise operably coupling a first stripline layer comprising one or more reactive splitters and one or more matched splitters to a second stripline layer comprising one or more reactive splitters.

8 Claims, 11 Drawing Sheets

STRIPLINE ANTENNA FEED NETWORK

FIELD OF THE INVENTION

This invention relates generally to the transmission and reception of radio frequency signals and, more particularly to a stripline antenna feed network.

BACKGROUND OF THE INVENTION

In many telecommunications applications, microstrip antennas are employed. There are several types of microstrip antennas (also known as printed antennas), the most common of which is the microstrip patch antenna. A microstrip patch antenna is a narrowband, wide-beam antenna fabricated by etching an antenna element pattern in metal trace bonded to an insulating substrate. Because such antennas may be low profile, mechanically rugged and conformable, they are often employed on aircraft and spacecraft, or are incorporated into mobile radio communications devices.

SUMMARY OF THE INVENTION

A stripline antenna feed network is described.

The stripline antenna feed network may comprise: (a) a first stripline layer comprising one or more reactive splitters and one or more matched splitters; and (b) a second stripline layer comprising one or more reactive splitters.

A method of manufacturing a stripline antenna feed network may comprise: (a) operably coupling a first stripline layer comprising one or more reactive splitters and one or more matched splitters to a second stripline layer comprising one or more reactive splitters.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Figure 1:
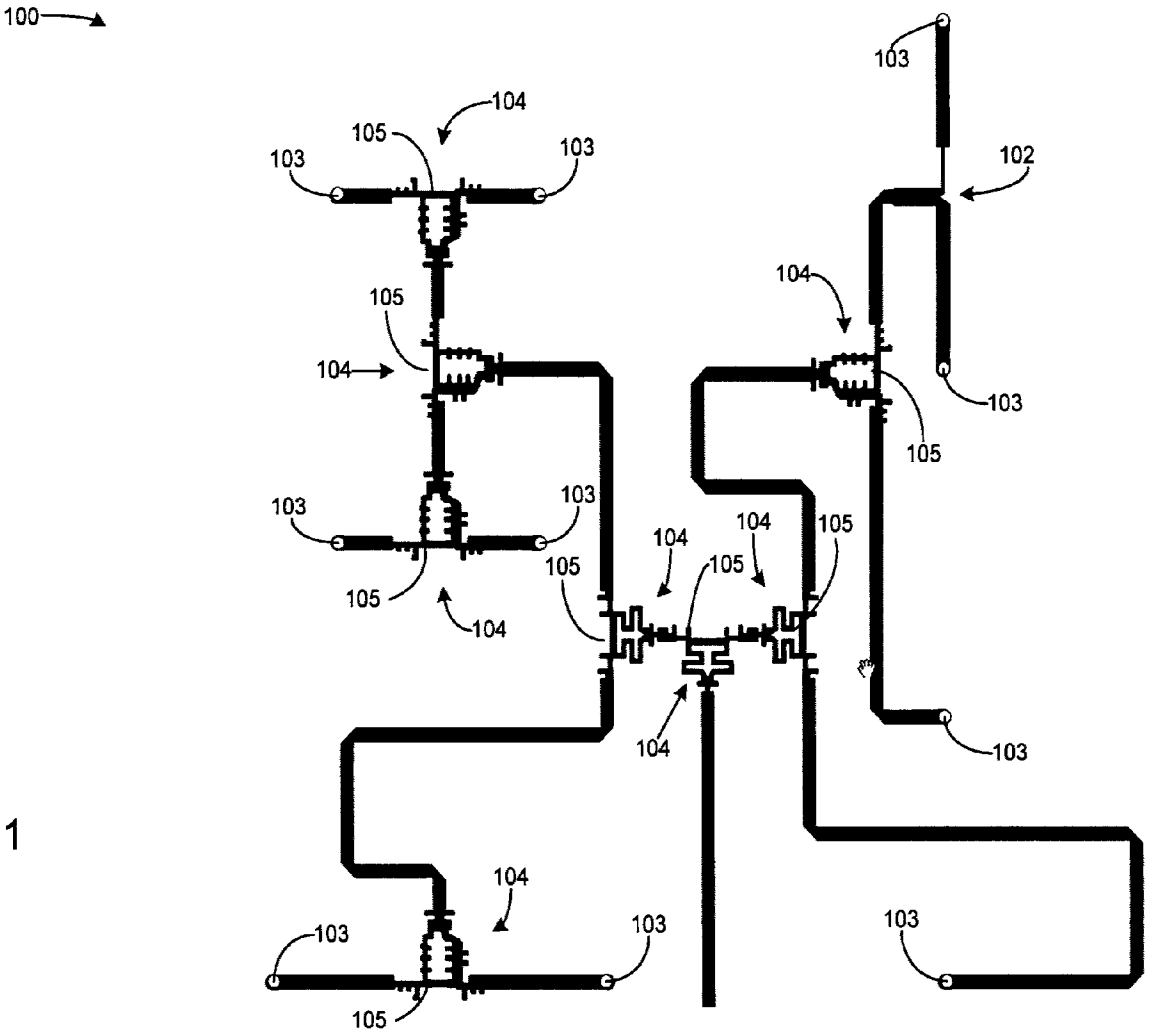
FIG. 1 depicts a reactive/matched stripline feed network.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. Reference will now be made, in detail, to presently preferred embodiments of the invention, examples of which are illustrated in the accompanying drawings.

A stripline antenna feed network as described herein may include a reactive/matched stripline feed network 100 and a reactive stripline feed network 300.

Figure 3:
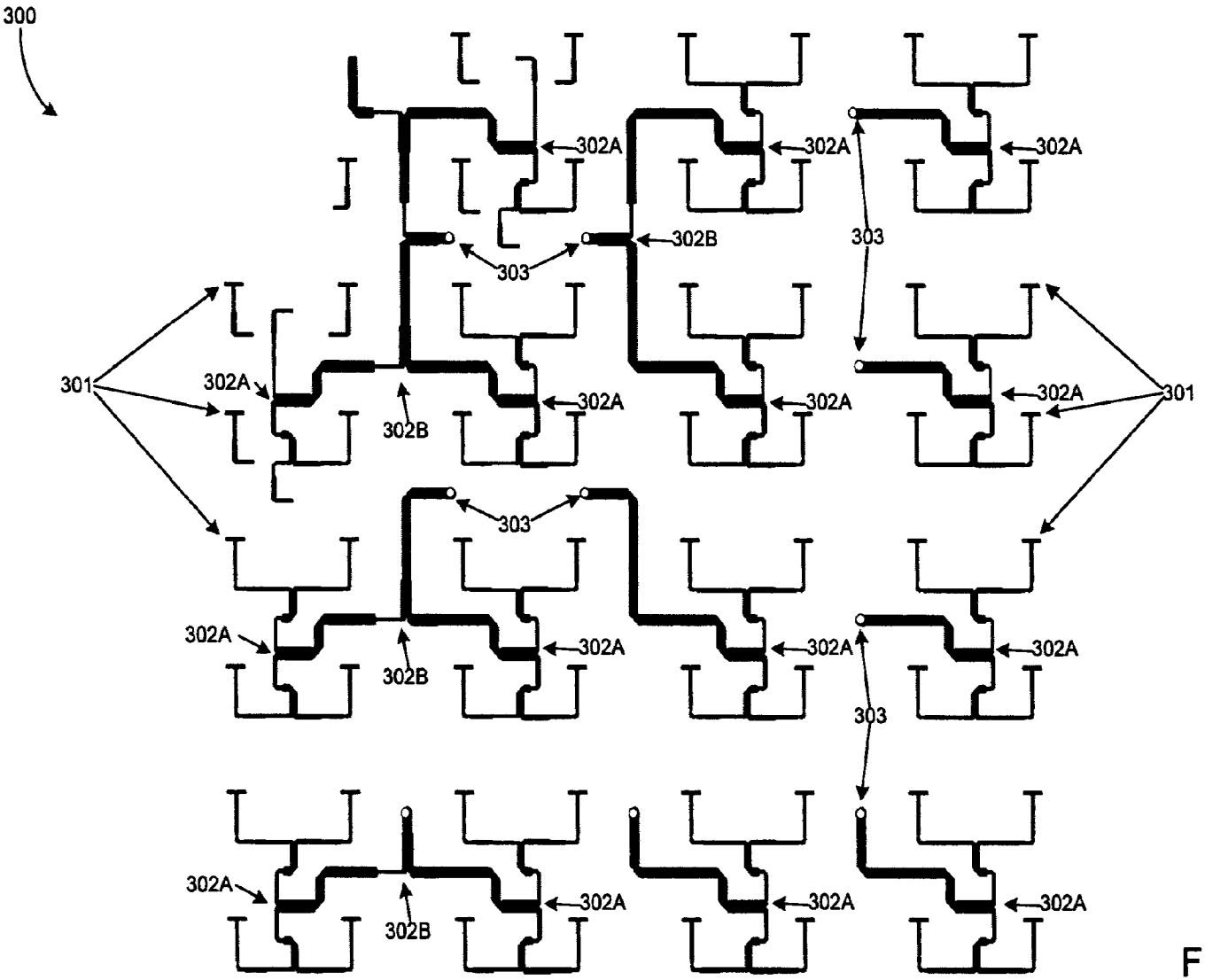
FIG. 3 depicts a reactive stripline feed network.

Referring to FIG. 1, the reactive/matched stripline feed network 100 may include at least one reactive splitter 102 and at least one matched splitter 104 (e.g. Wilkinson-type splitters). A reactive splitter may be a 4:1 reactive splitter 302A (as shown in FIG. 3). A matched splitter 104 may be a 2:1 matched splitter. A matched splitter 104 may include an embedded resistor 105. An embedded resistor 105 may include a thin-film resistor-conductor layer. Numerous thin-film resistor-conductor layers may be used. For example, an embedded resistor 105 may include Ohmega-Ply® resistor-conductor material having an impedance of 25 ohms/square as manufactured by Ohmega Technologies, Inc. The reactive/matched stripline feed network 100 may include an input/output feed line 106 providing input/output signals to the reactive/matched stripline feed network 100. The feed lines of the reactive stripline feed network 300 may be coupled to the reactive/matched stripline feed network 100 by at least one vertical transition 103. The vertical transition 103 may include a circuit board via.

Figure 2:
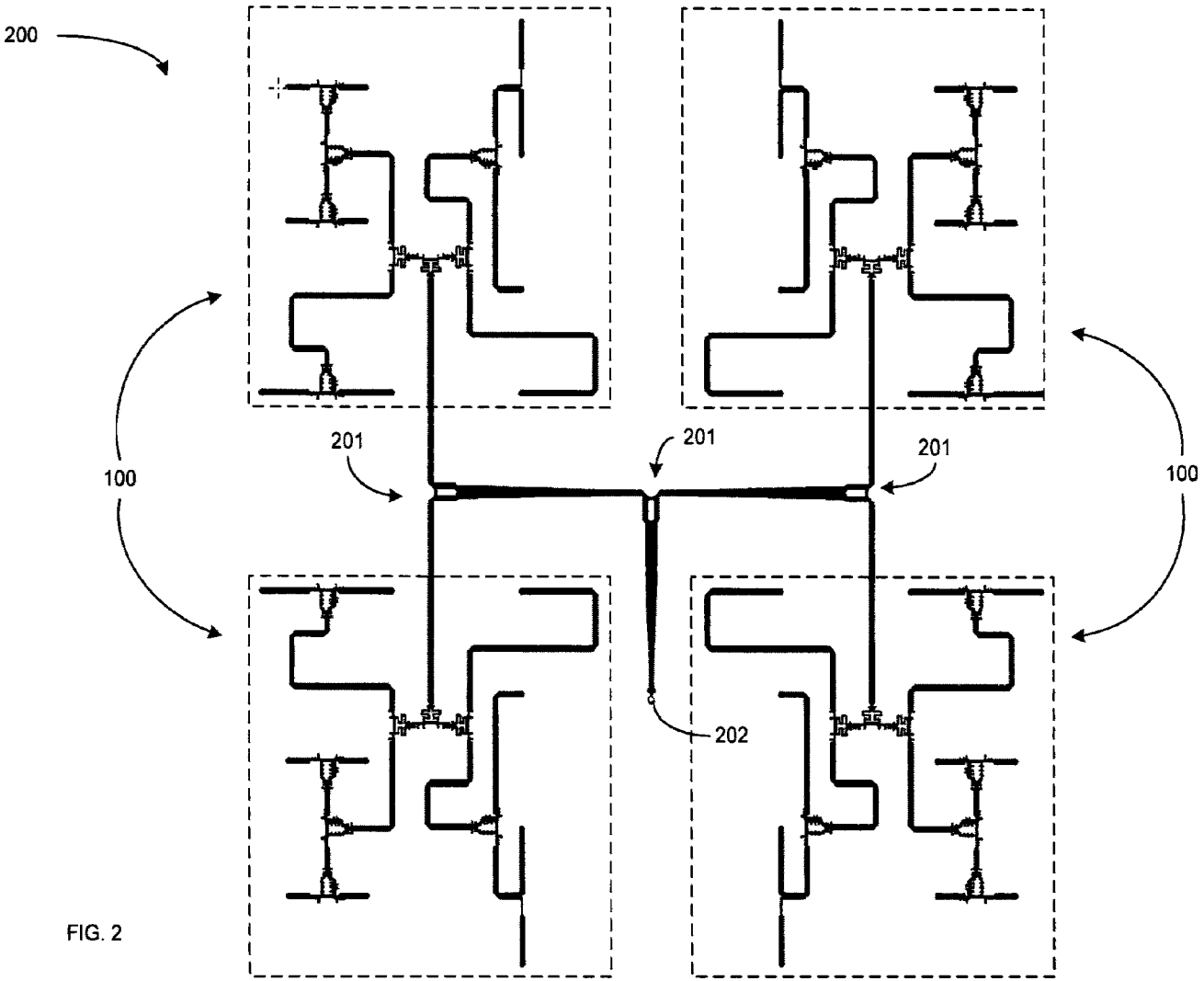
FIG. 2 depicts a reactive/matched printed circuit board layer.

Referring to FIG. 2, a reactive/matched PCB layer 200 is illustrated. The reactive/matched PCB layer 200 may include one or more instances of the reactive/matched stripline feed network 100. The reactive/matched PCB layer 200 may further include a combiner 201 which may combine signals transceived from the reactive/matched PCB layer 200. The reactive/matched PCB layer 200 may include a vertical transition 202 by which signals may be transceived to a conductive layer 701.

Referring to FIG. 3, the reactive stripline feed network 300 may include at least one reactive splitter 302 for splitting and/or combining signals. The reactive splitter may be a 4:1 reactive splitter 302A and/or a 2:1 reactive splitter 302B. The feed lines of the reactive stripline feed network 300 may have an impedance of about 78 ohms and a line width of about 10 mil. Such a configuration may allow for RF manifolding to be implemented on the same layer as the radiating element feed. The reactive stripline feed network 300 may include a stripline feed network feeding at least one antenna coupling 301. An antenna coupling 301 may couple feed layer components to a radiator structure (e.g. a dipole antenna structure) located on a separate PCB layer. Numerous antenna couplings may be used. For example, the antenna coupling 301 may include, but is not limited to, slot coupling, probe coupling, proximity coupling, or edge feeding. The feed lines of the reactive stripline feed network 300 may be coupled to the reactive/matched stripline feed network 100 by at least one vertical transition 303. The vertical transition 303 may include a circuit board via.

Figure 4:
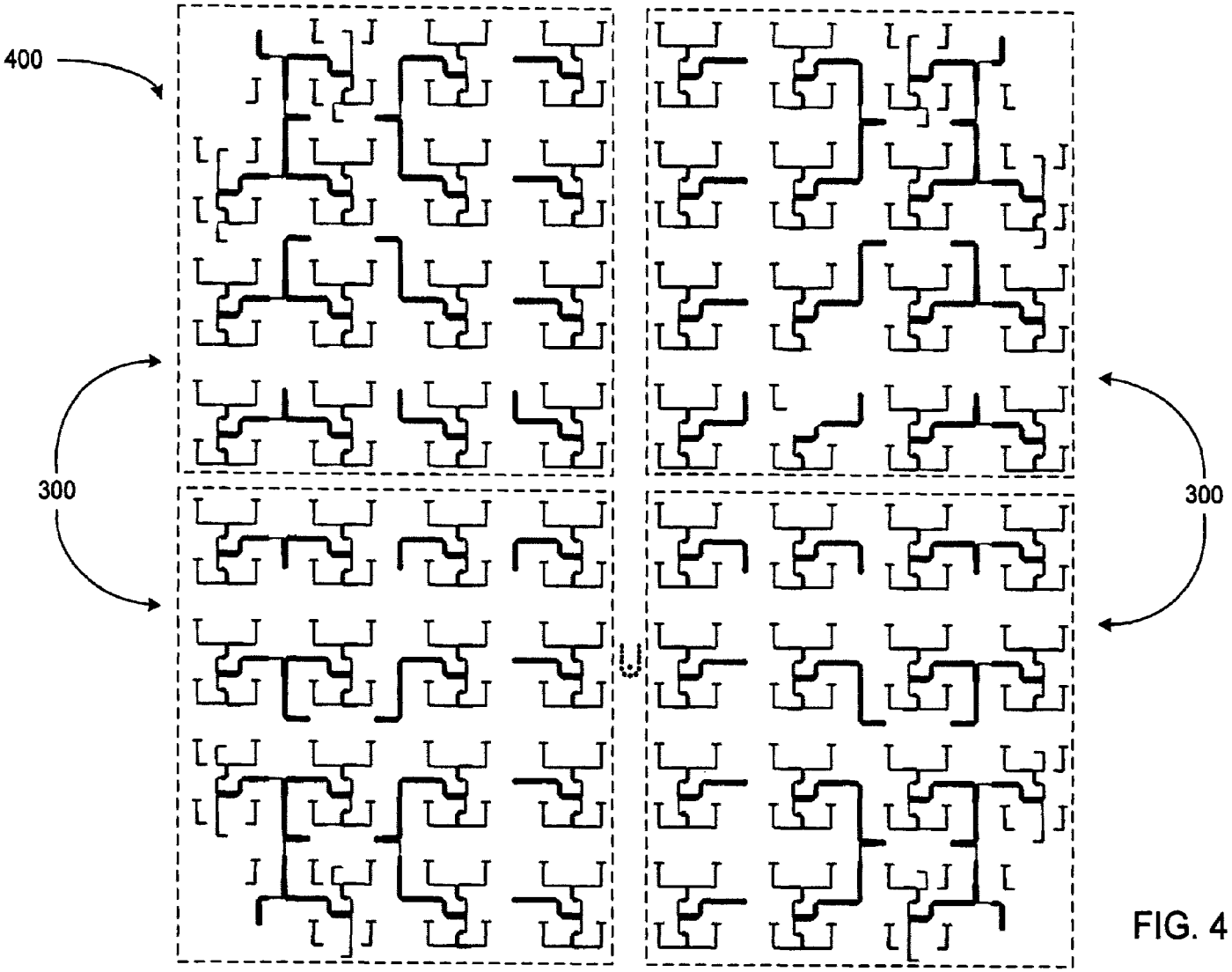
FIG. 4 depicts a reactive printed circuit board layer.

Referring to FIG. 4 a reactive PCB layer 400 is illustrated. The reactive PCB layer 400 may include one or more instances of the reactive stripline feed network 300. For example, the reactive PCB layer 400 may include four instances of the reactive stripline feed network 300.

Figure 5:
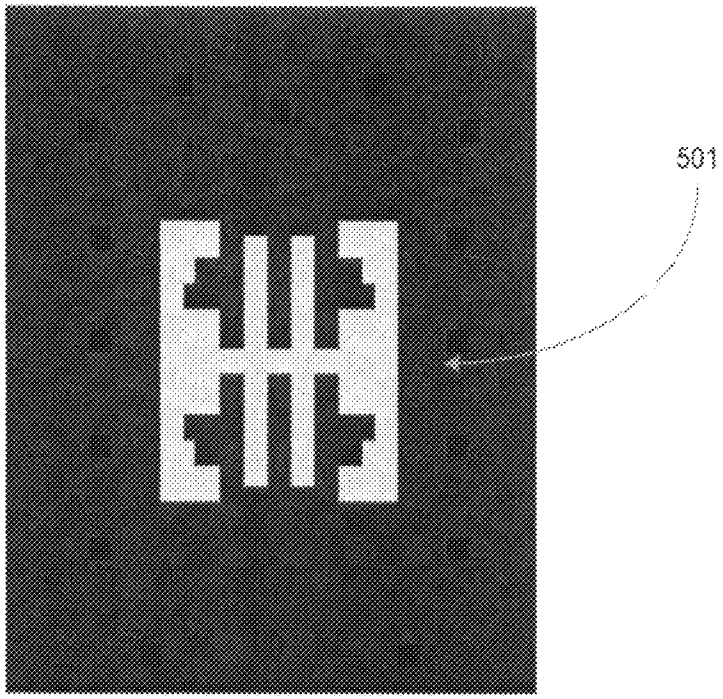
FIG. 5 depicts a slot radiator unit cell.

Referring to FIG. 5 a slot radiator unit cell 500 is illustrated. The slot radiator unit cell 500 may include a ground plane 501 defining an aperture 502. The aperture 502 may be configured so as to reduce the size of its footprint in the reactive PCB layer 400 so as to provide a low return loss response over a broad band (e.g. from about 15.2 to about 18.2 GHz).

Figure 6:
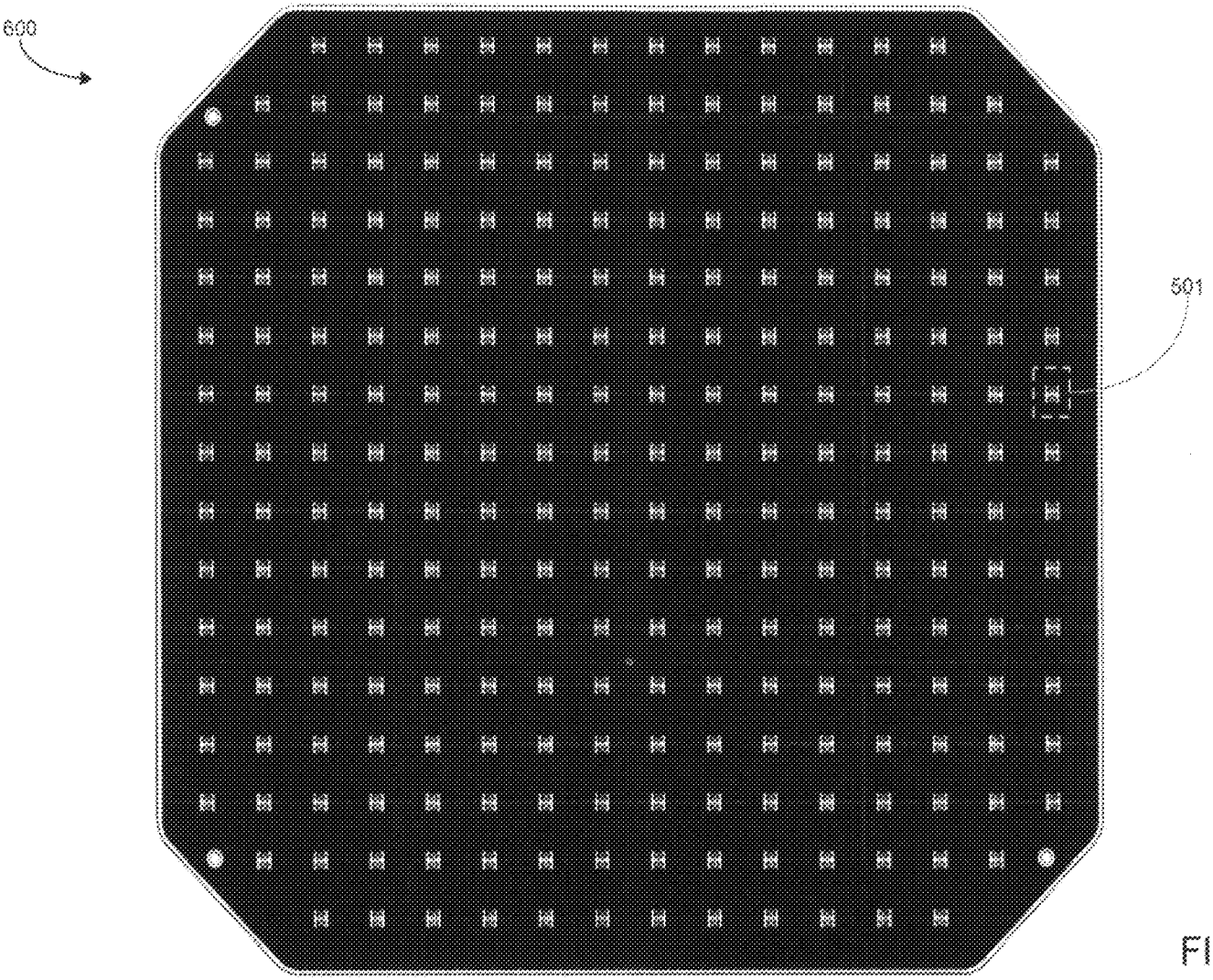
FIG. 6 depicts a slot coupling layer.

Referring to FIG. 6, a slot coupling layer 600 is illustrated. The slot coupling layer 600 may include one or more instances of the slot radiator unit cell 500. For example, the reactive PCB layer 400 may include 244 instances of the slot radiator unit cell 500 wherein each antenna coupling 301 of the reactive PCB layer 400 couples to a slot radiator unit cell 500 of the slot coupling layer 600.

Figure 7:
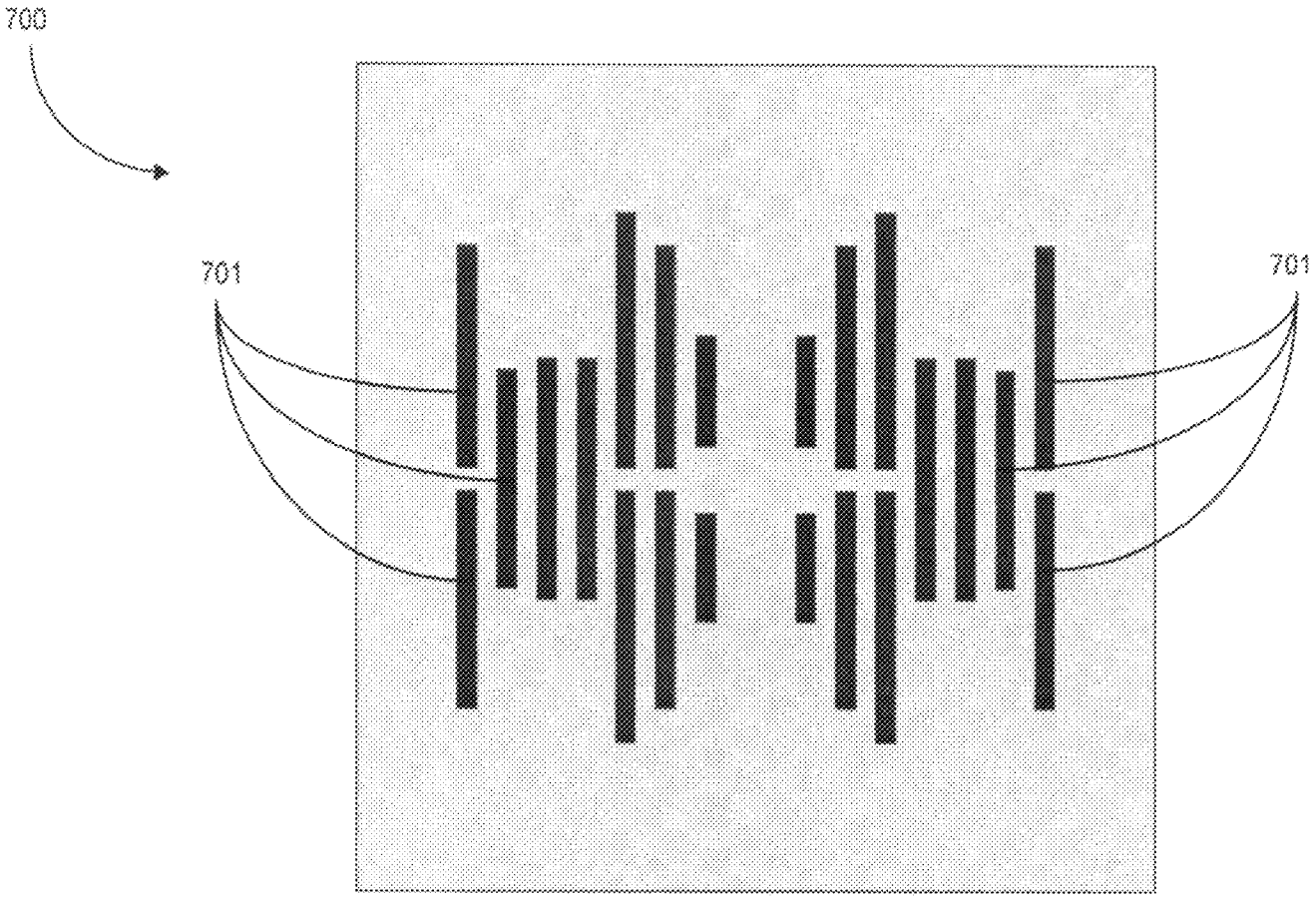
FIG. 7 depicts a dipole unit cell.

Referring to FIG. 7, a stripline dipole unit cell 700 is illustrated. The stripline dipole unit cell 700 may include at least one strip line element 701.

Figure 8:
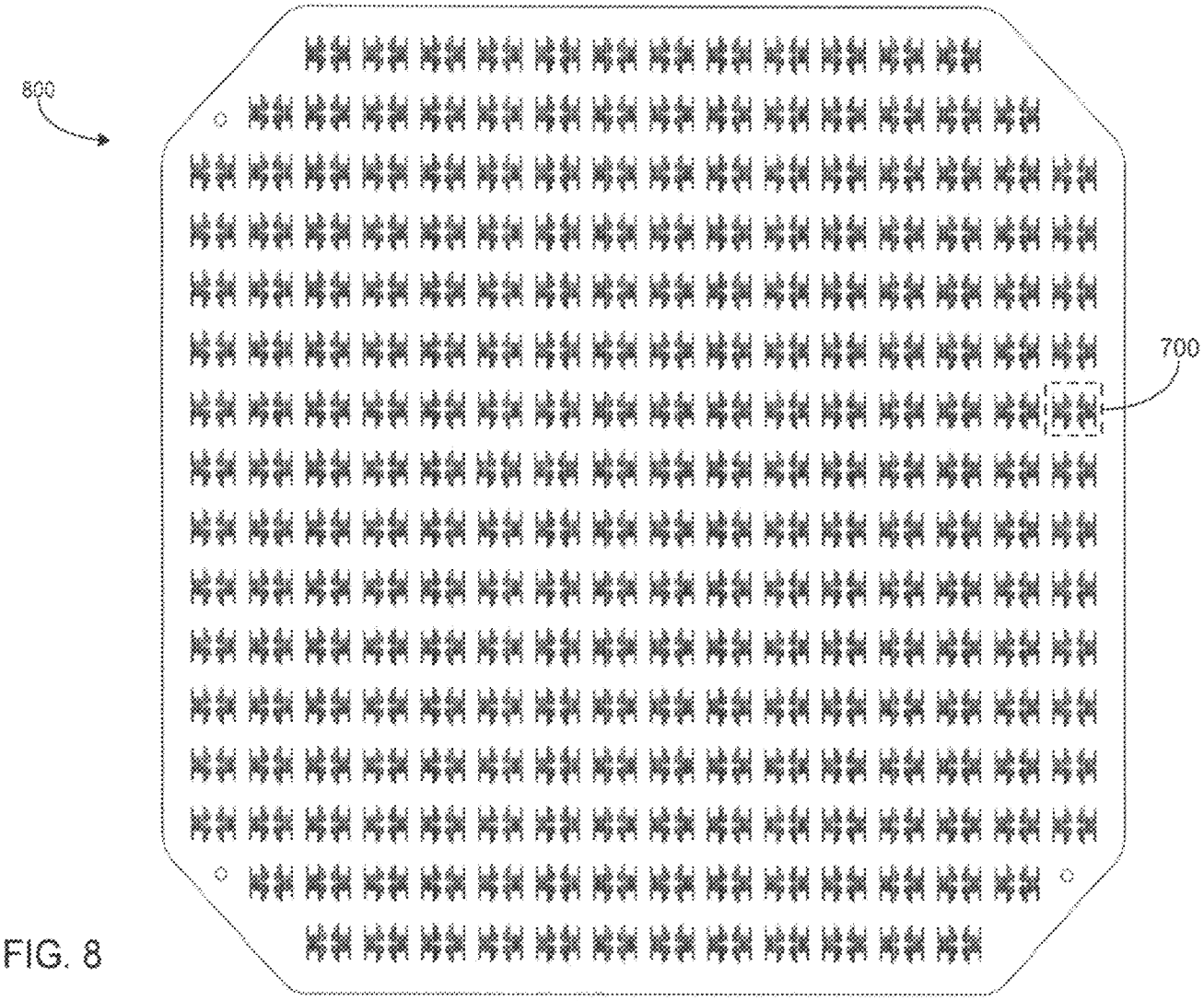
FIG. 8 depicts a dipole layer.

Referring to FIG. 8, a first dipole layer 800 is illustrated. The first dipole layer 800 may include one or more instances of the stripline dipole unit cell 700. For example, the first dipole layer 800 may include 244 instances of the stripline dipole unit cell 700 wherein each stripline dipole unit cell 700 couples to a slot radiator unit cell 500 of the slot coupling layer 600.

Figure 9:
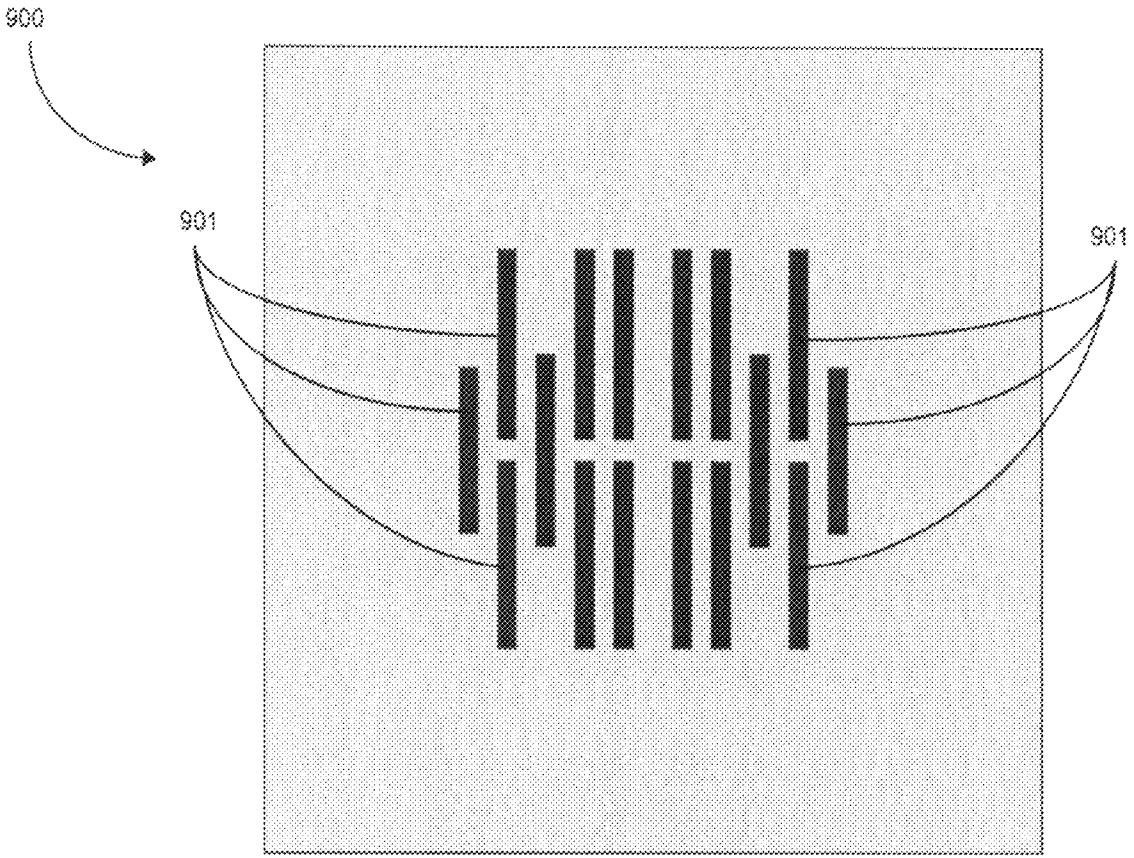
FIG. 9 depicts a dipole unit cell.

Referring to FIG. 9, a stripline dipole unit cell 900 is illustrated. The stripline dipole unit cell 900 may include at least one strip line element 901.

Figure 10:
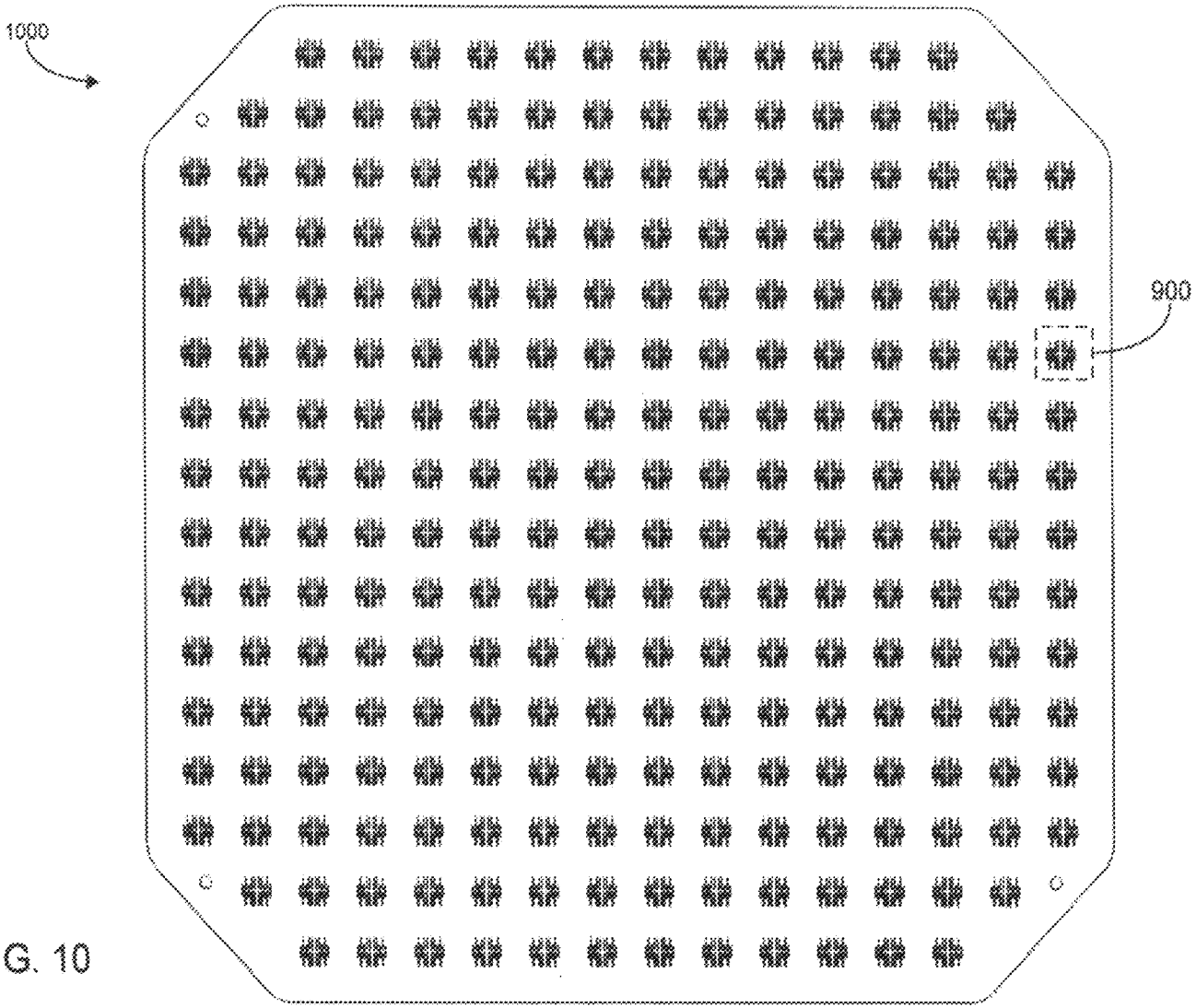
FIG. 10 depicts a dipole layer.

Referring to FIG. 10, a second dipole layer 1000 is illustrated. The second dipole layer 1000 may include one or more instances of the stripline dipole unit cell 900. For example, the second dipole layer 1000 may include 244 instances of the stripline dipole unit cell 900 wherein each stripline dipole unit cell 900 couples to a stripline dipole unit cell 700 of the first dipole layer 800.

Figure 11:
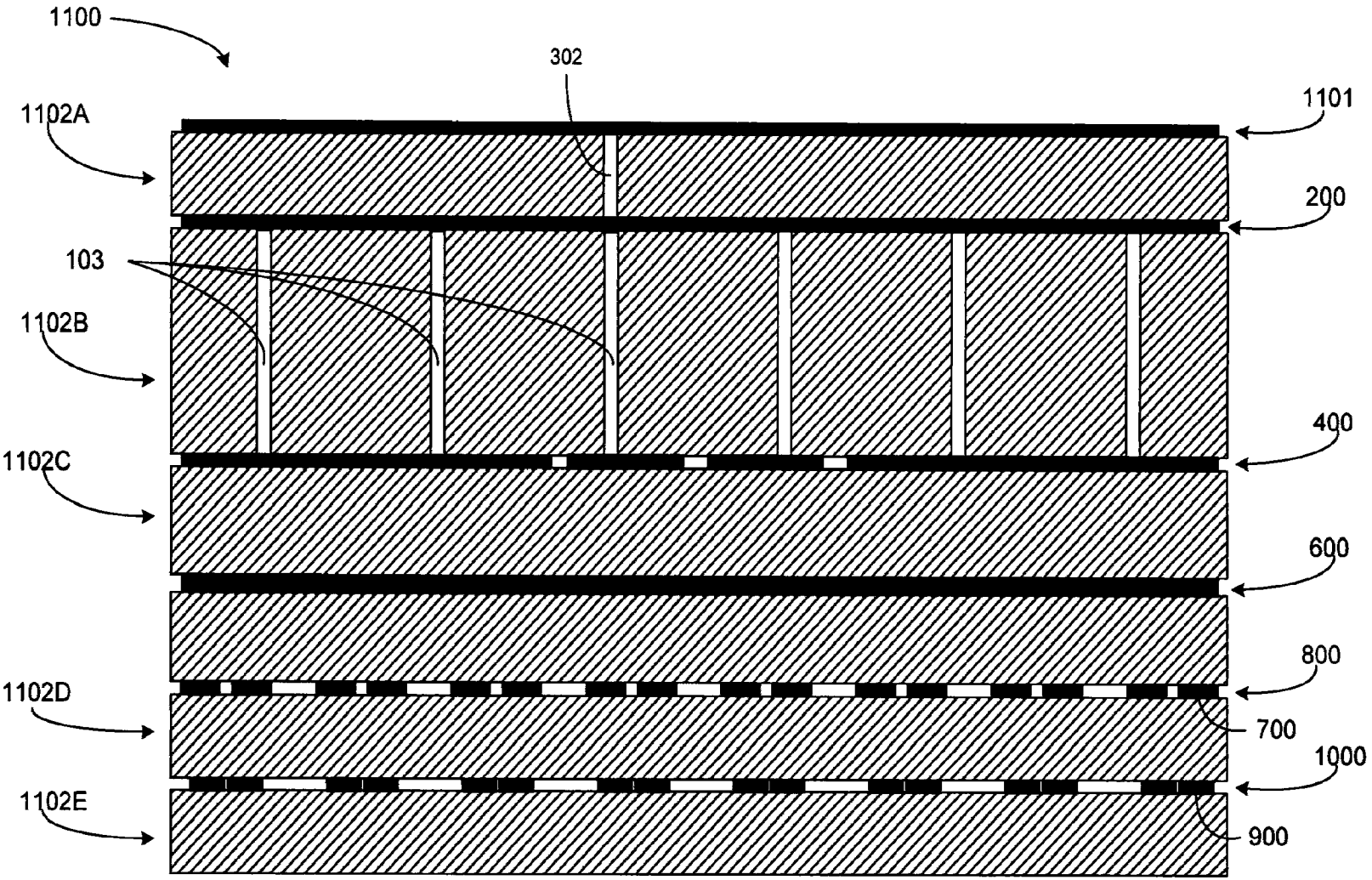
FIG. 11 depicts a cross-sectional view of a stripline antenna feed network.

Referring to FIG. 11, a cross-sectional view of a circuit board 1100 including the reactive stripline feed network 200 and the reactive/matched stripline feed network 100 is illustrated. The circuit board 1100 may include a conductive layer 1101. The conductive layer 1101 may include a layer selected from numerous conductive compounds. For example, the conductive layer 1101 may include a copper layer.

The circuit board 1100 may include at least one laminate layer 1102 (e.g. a laminate layer 1102A, a laminate layer 1102B, a laminate layer 1102C, a laminate layer 1102D, and a laminate layer 1102E). The laminate layer 1102 may include a layer selected from numerous compositions. For example, the laminate layer 1102 may include, but is not limited to, FR-4, FR-2, Composite epoxy materials, CEM-1, 5, Polyimide, GETEK, BT-Epoxy, Cyanate Ester, Pyralux, Polytetrafluoroethylene, and the like. A laminate layer 1102 may include CLTE™ compositions manufactured by Arlon®, Inc. The laminate layer may have, but is not limited to, a dielectric constant of from about 2.9 to about 3.0.

The reactive stripline feed network 300 disposed on reactive PCB layer 400 may be coupled to feed lines of the reactive/matched stripline feed network 100 disposed on reactive/matched PCB layer 200 by at least one vertical transition 103/303. The vertical transition 103/303 may include a circuit board via. The reactive stripline feed network 300 disposed on reactive PCB layer 400 may be coupled to the conductive layer 1101 by at least one vertical transition 302. The vertical transition 302 may include a circuit board via.

It is believed that the present invention and many of its attendant advantages will be understood from the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A stripline antenna feed network comprising:

a first stripline layer comprising one or more reactive splitters including two or more non-isolated ports and one or more matched splitters including two or more substantially isolated ports; and a second stripline layer non-coplanar to the first stripline layer comprising one or more reactive splitters.

2. The stripline antenna feed network of claim 1, further comprising: a first dipole layer comprising one or more dipole unit cells.

3. The stripline antenna feed network of claim 2, further comprising: a second dipole layer comprising one or more dipole unit cells.

4. The stripline antenna feed network of claim 1, further comprising: a slot coupling layer.

5. A method of manufacturing a stripline antenna feed network comprising:

operably coupling a first stripline layer comprising one or more reactive splitters including two or more non-isolated ports and one or more matched splitters including two or more substantially isolated ports to a second stripline layer non-coplanar with the first stripline layer comprising one or more reactive splitters including two or more non-isolated ports.

6. The method of claim 5, further comprising:

operably coupling a first dipole layer comprising one or more dipole unit cells to the first stripline layer.

7. The method of claim 6, further comprising:

operably coupling the first dipole layer to a second dipole layer comprising one or more dipole unit cells.

8. The method of claim 7, further comprising: operably coupling the first dipole layer to the second dipole layer via a slot coupling layer.

* * * * *